US007441630B1

(12) United States Patent
Herrington et al.

(10) Patent No.: US 7,441,630 B1
(45) Date of Patent: Oct. 28, 2008

(54) MULTI-DRIVER SPEAKER SYSTEM

(75) Inventors: Daniel A. Herrington, Higganum, CT (US); Richard A. Corciullo, Middletown, CT (US)

(73) Assignee: PBP Acoustics, LLC, Guilford, CT (US)

( * ) Notice: Subject to any disclaimer, the term of this patent is extended or adjusted under 35 U.S.C. 154(b) by 209 days.

(21) Appl. No.: 11/063,405

(22) Filed: Feb. 22, 2005

(51) Int. Cl.
*H04R 5/02* (2006.01)

(52) U.S. Cl. ..... 181/199; 181/198; 181/148; 181/153; 381/300; 381/304; 381/305; 381/335

(58) Field of Classification Search ..... 181/181, 181/199, 198, 148, 153; 381/386, 387, 390, 381/300, 304, 305, 332, 335; 362/11, 12, 362/250, 402, 403
See application file for complete search history.

(56) References Cited

U.S. PATENT DOCUMENTS

| | | | | | |
|---|---|---|---|---|---|
| 2,090,439 | A * | 8/1937 | Carwardine | 248/160 |
| 4,139,734 | A | 2/1979 | Fincham | |
| 4,213,172 | A * | 7/1980 | Scattolin et al. | 362/413 |
| 4,315,102 | A | 2/1982 | Eberbach | |
| 4,450,322 | A * | 5/1984 | Wilson | 381/59 |
| 4,757,544 | A * | 7/1988 | Guy | 381/387 |
| 4,865,153 | A * | 9/1989 | Toyoda | 181/153 |
| 4,882,760 | A * | 11/1989 | Yee | 381/335 |
| 4,932,060 | A * | 6/1990 | Schreiber | 381/300 |
| 4,953,223 | A * | 8/1990 | Householder | 381/387 |
| 5,097,400 | A * | 3/1992 | Cvek | 362/287 |
| 5,613,771 | A * | 3/1997 | Siverling | 362/401 |
| 5,677,896 | A * | 10/1997 | Nunes | 368/10 |
| 5,802,194 | A * | 9/1998 | Yamagishi et al. | 381/386 |
| 5,872,856 | A * | 2/1999 | Huh | 381/387 |
| 6,467,936 | B1 * | 10/2002 | Golemba | 362/413 |
| 6,584,377 | B2 * | 6/2003 | Saijo et al. | 700/245 |
| 6,603,859 | B1 | 8/2003 | Asano | |
| 6,603,862 | B1 | 8/2003 | Betts | |
| 6,663,266 | B2 * | 12/2003 | Huang | 362/402 |
| 6,775,385 | B1 * | 8/2004 | Coombs | 381/99 |
| 6,856,094 | B2 * | 2/2005 | Sherman | 315/57 |
| 6,856,692 | B2 * | 2/2005 | Lin | 381/395 |
| 2004/0114770 | A1 | 6/2004 | Pompei | |

FOREIGN PATENT DOCUMENTS

| | | | |
|---|---|---|---|
| DE | 4 227 696 | A1 | 2/1994 |
| DE | 4227696 | A1 * | 2/1994 |
| GB | 2 044 038 | A | 10/1980 |
| JP | 63036698 | A * | 2/1988 |

* cited by examiner

*Primary Examiner*—Lincoln Donovan
*Assistant Examiner*—Jeremy Luks
(74) *Attorney, Agent, or Firm*—Bachman & LaPointe, P.C.

(57) ABSTRACT

A speaker unit includes first and second drivers carried by first and second enclosures. A first linkage supports the second driver enclosure relative to the first driver enclosure and provides at least two positional degrees of freedom of movement of the second driver enclosure relative to the first driver enclosure.

27 Claims, 6 Drawing Sheets

MULTI-DRIVER SPEAKER SYSTEM

BACKGROUND OF THE INVENTION

The invention relates to audio speakers. More particularly, the invention relates to stereo loudspeakers.

A well developed field exists in loudspeaker construction. Typical loudspeakers include one or more drivers mounted in one or more housings. Many housing configurations exist. The most common configuration is a right parallelepiped. In such a configuration, multiple drivers face forward along one of the long sides of the parallelepiped enclosure.

Other enclosure configurations exist with much recent effort being placed in fairly convoluted structures. Another recent trend has been toward multi-enclosure systems. These include systems wherein a relatively small enclosure for a high frequency driver is mounted atop a larger enclosure for one or more lower frequency drivers.

SUMMARY OF THE INVENTION

A speaker unit includes first and second drivers carried by first and second enclosures. A first linkage supports the second driver enclosure relative to the first driver enclosure and provides at least two positional degrees of freedom of movement of the second driver enclosure relative to the first driver enclosure.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
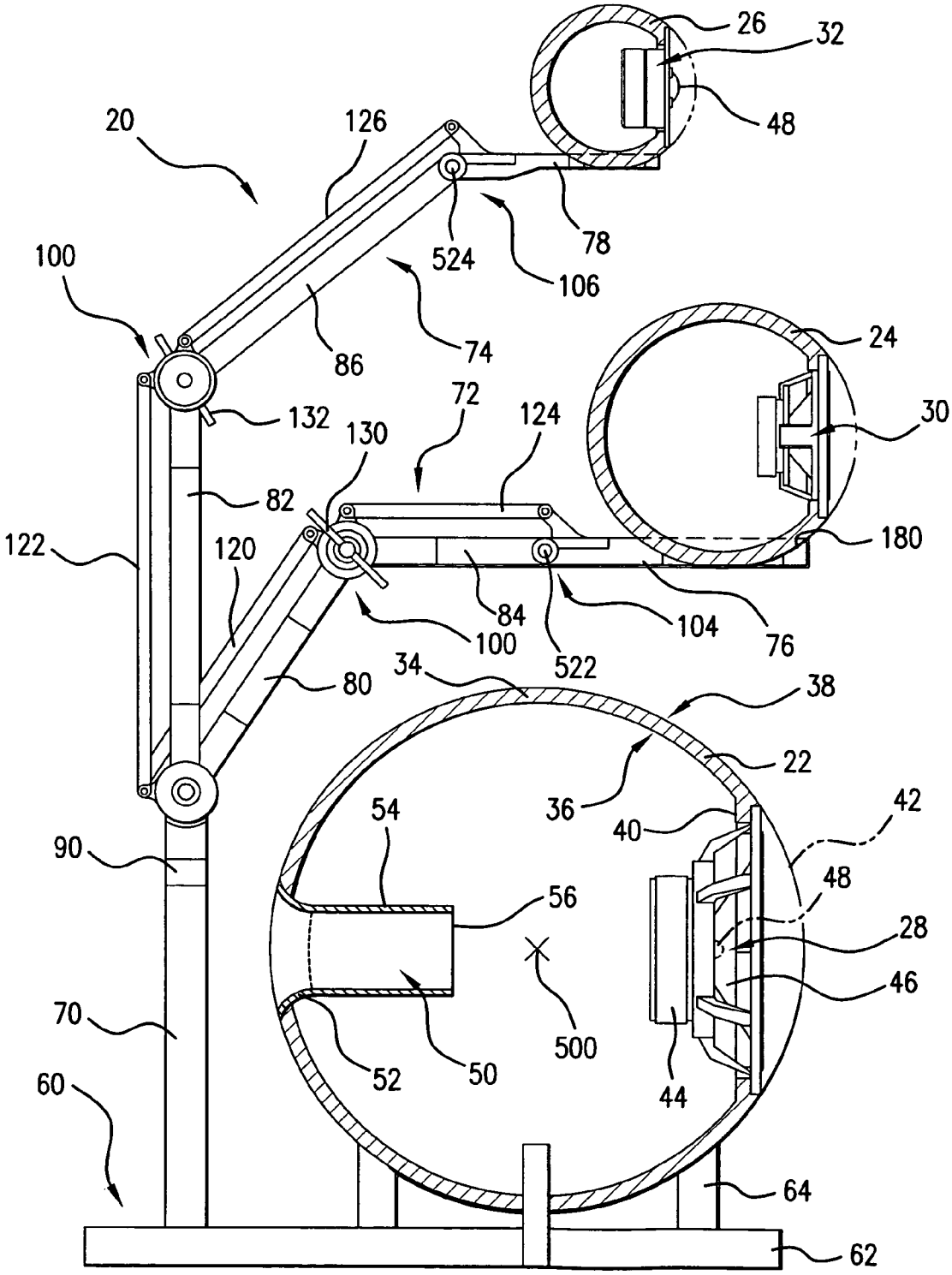
FIG. 1 is a partially cut-away side view of a loudspeaker unit.

FIG. 1 shows a loudspeaker unit 20 having three speaker (driver) enclosures (housings) 22, 24, and 26. The exemplary enclosures respectively house low (bass/woofer), midrange, and high (tweeter) frequency drivers 28, 30, and 32, respectively, and at least partially enclose spaces behind (backspaces of) the drivers. Exemplary bass, midrange and high frequency driver diameters use 9-15 inches (e.g., 11 inches), 3-7 inches (e.g., 5 inches), and 0.5-2.5 inches (e.g., 1 inch), respectively.

Each exemplary enclosure has a first portion 34 being a major portion of a spherical shell having a center 500 along a central longitudinal axis 502, an inner/interior surface 36, and an outer/exterior surface 38 with an essentially uniform thickness therebetween. At a forward end of the first portion 34 each exemplary housing includes a centrally apertured driver mounting flange 40, providing structural reinforcement and supporting and accommodating the associated driver. In the exemplary housings, the flange front surface has a rebate accommodating a rim of the associated driver. A sound-transparent decorative cover 42 may be mounted over the flange and may have an exterior contour continuing the spherical shape of the surface 38. Each of the drivers may have a coil/magnet assembly 44 and a vibratory member such as a cone 46. A dust cover 48 may cover the coil and may be integrated with the cone (e.g., at the proximal end).

The exemplary bass enclosure includes a port 50 having a horn 52 extending forward from an aperture in the back of the first portion. A circular cylindrical tube 54 extends forward from the horn to a rim 56. The port may be configured using conventional bass reflex principles based upon specifications of the driver to provide smooth (or other characteristic) frequency cy response.

The exemplary housings are formed of a cementaceous material (e.g., a concrete, a filled epoxy-cement mixture, or the like) and may be formed by casting/molding, shelling, or otherwise. Exemplary materials are of relatively high density (e.g., 1.0-2.5 g/cm$^3$). Lighter materials are also possible, especially for the midrange where the enclosure size may produce an enclosure weight otherwise too great for the arm. Exemplary lighter materials have densities of 0-2-1.0 g/cm$^3$ (e.g., lightweight concretes). Exemplary diameters of the inner surface 36 are 30-60 cm for the bass enclosure 22, a lesser 15-35 cm for the midrange enclosure 24, and a yet lesser 5-20 cm for the tweeter enclosure 26. Exemplary thicknesses are 1-4 cm, more narrowly 1.5-3 cm. The combination of generally spherical shape and high density/weight material is believed to provide a clean sound reproduction for each driver. Further modifications are possible for sound clarity, aesthetic, or manufacturing concerns. There may be various departures from sphericity. For example, structural and mounting features may be present. Changes to the particular shape of the doubly concave inner surface may compensate for the sound reproduction properties of any particular driver. Minor portions of a sphere, ellipisoid, or the like may also be used (i.e., where the front flange is aft of the center of such sphere or ellipsoid).

The enclosures are supported by a stand structure 60 having an exemplary cruciform platform 62 to support the base enclosure 22 atop a floor surface. From each of the platform arms, the platform leg, and the platform head, a post 64 extends upward to engage the outer surface of the bass enclosure 22. In the exemplary stand, the bass enclosure may be rotated on the posts in pitch, yaw, and roll about the enclosure's center while being retained against translation relative to the platform.

For supporting the other enclosures, a main post 70 extends upward from near a rear end of the platform leg. A pair of arm-like linkages (arms) 72 and 74 have distal portions 76 and 78 respectively supporting the midrange and tweeter enclosures. The exemplary arms have respective main proximal links 80 and 82 and main intermediate links 84 and 86.

Figure 2:
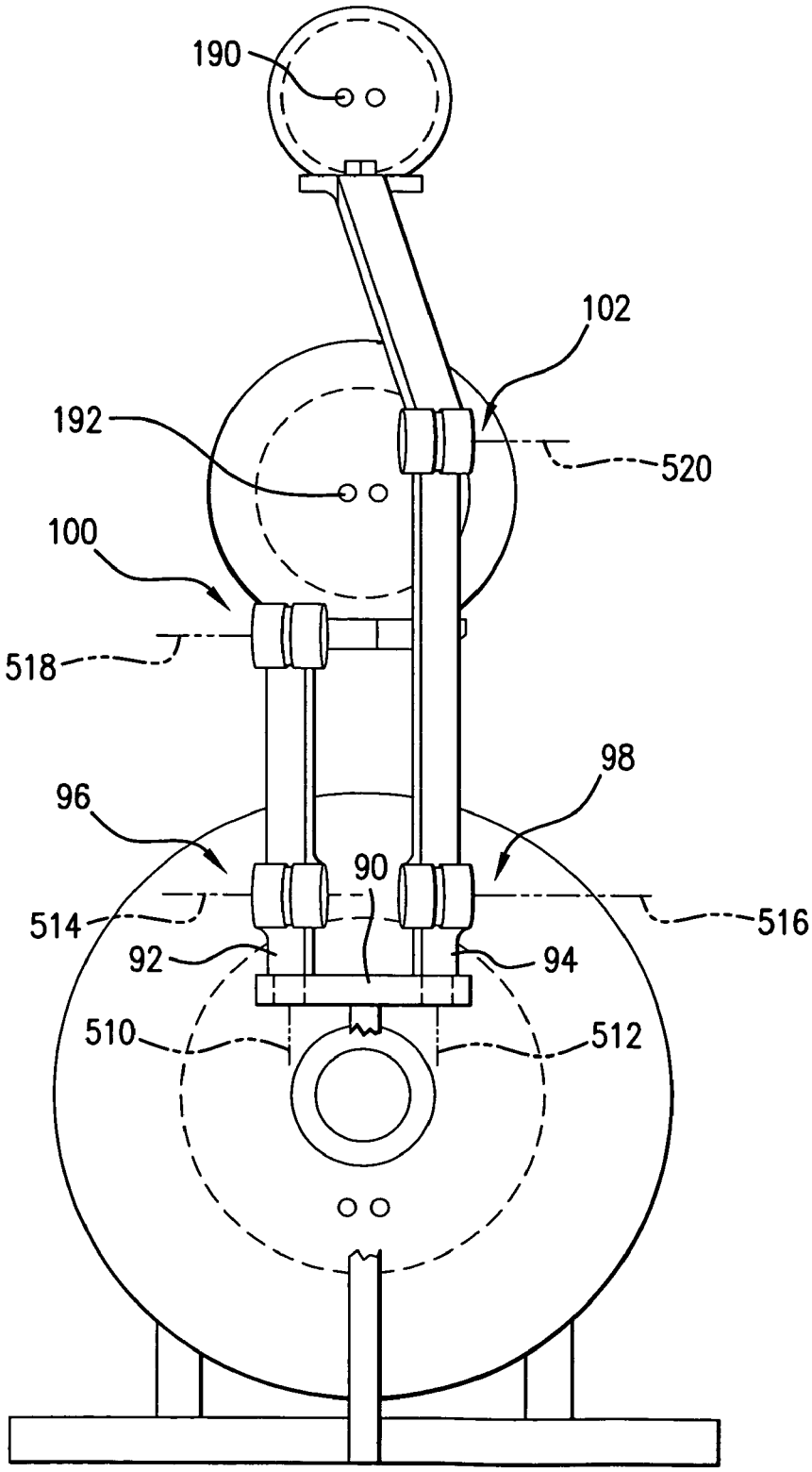
FIG. 2 is a partially schematic rear view of the unit of FIG. 1.

FIG. 2 more schematically shows the exemplary relationship between the arms 72 and 74 and the main post 70. A transverse crossbar 90 is fixed at the upper end of the main post 70, with the arms 72 and 74 extending upward from respective left and right ends of crossbar. Each arm has a respective root element 92; 94 mounted to the crossbar for relative rotation about an associated vertical axis 510; 512. A proximal joint 96; 98 couples a distal end of the root portion to the associated proximal link for relative rotation about a horizontal axis 514; 516. An intermediate joint 100; 102 couples a distal end of the proximal link to the intermediate link for relative rotation about a horizontal axis 518; 520. A distal joint 104; 106 (FIG. 1) couples a distal end of the intermediate link to the associated distal link for relative rotation about a horizontal axis 522; 524.

FIG. 1 shows a proximal auxiliary link 120; 122 associated with each main proximal link 80; 82. An intermediate auxiliary link 124; 126 is associated with each main intermediate link 84; 86. Each main proximal and intermediate link along with its associated auxiliary link and the adjacent joints combine to form a parallelogram mechanism. Each intermediate joint 100; 102 is common to the two parallelogram mechanisms of the associated arm. Thus if the intermediate joint is locked against rotation, the proximal parallelogram mechanism also locks the proximal joint 96; 98 and the distal parallelogram mechanism also locks the distal joint 104; 106. Locking and unlocking may be achieved by means of a locking handle 130; 132 at the intermediate joint and rotatable about the intermediate joint axis 518; 520.

Figure 3:
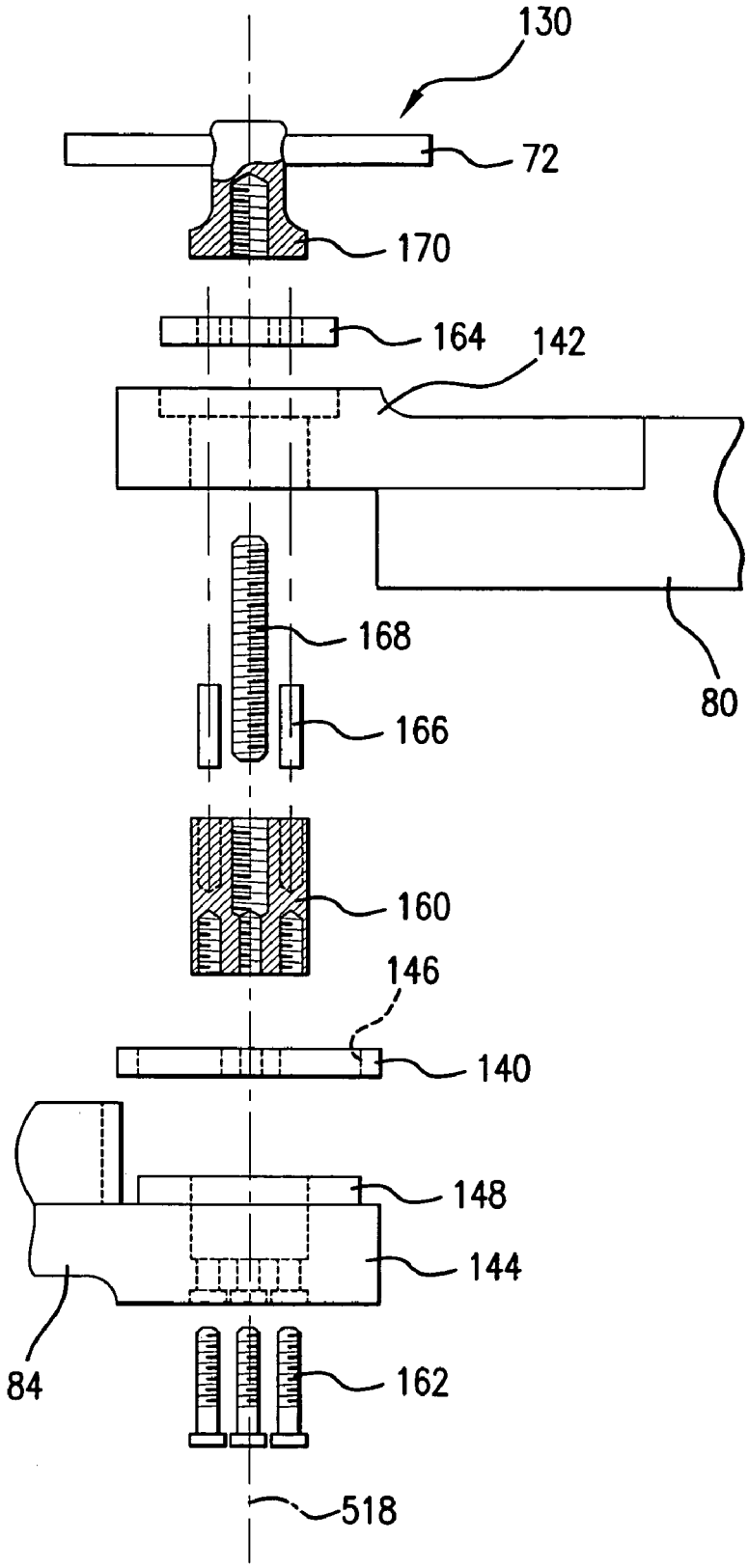
FIG. 3 is an exploded, transverse, partially sectional view of an intermediate joint of an arm of the unit of FIG. 1.
Figure 4:
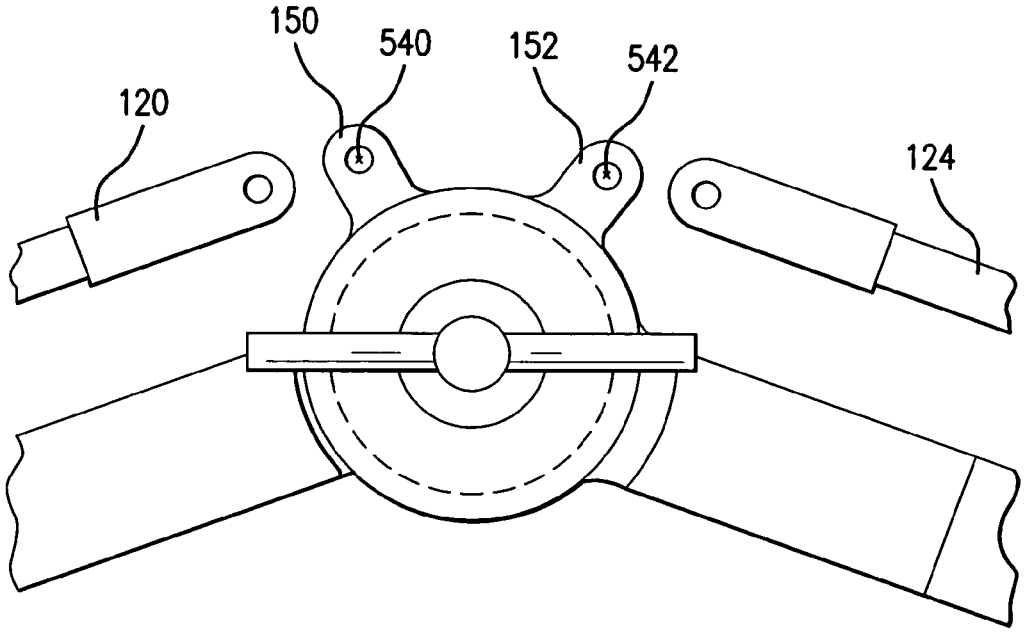
FIG. 4 is a partially exploded side view of the joint of FIG. 3.

FIGS. 3 and 4 show further details of the exemplary intermediate joint. To synchronize/couple the two parallelogram mechanisms, a ring 140 is mounted along the axis 518; 520. In the exemplary embodiment, the ring 140 is sandwiched between adjacent end portions 142 and 144 of the main proximal and intermediate links. In the exemplary embodiment, an inner aperture surface 146 of the ring 140 rides along a circumferential surface 148 of an inboard boss on the end portion 144. The ring 140 has a pair of ears 150 and 152 extending radially outward and coupled to the adjacent ends of the associated auxiliary links 120 and 124 for rotation about axes 540 and 542 (e.g., via pins (not shown)). Returning to FIG. 3, the exemplary intermediate joint includes a shaft element 160 concentrically within the ring 140. One end of the shaft element 160 is accommodated in a bore in the end portion 144 and secured thereto via fasteners (e.g., screws) 162. The other end passes within a bore in the end portion 142. An outboard bushing plate 164 is accommodated in a counterbore in an outboard surface of the end portion 142. The second end of the shaft 160 is secured to the bushing 164 against relative rotation by pins 166. A threaded shaft 168 has a first end portion threadingly engaged to a threaded bore in the second end of the shaft 160. A second end portion of the threaded shaft 168 is threadingly engaged to a central threaded bore in a central body 170 of the handle 130. A handle shaft 172 extends transversely through a transverse bore in an outboard end portion of the central body 170. Tightening of the handle 170 thus compresses the sandwiched components together to frictionally resist rotation. Loosening allows relative rotation. Alternative embodiments could include a detent mechanism providing stepwise rather than continuous orientation changes. Yet alternative embodiments could include other lockout structures. Exemplary materials for the structural components are aluminum alloys.

With its handle loosened, each arm may be articulated to provide the associated enclosure with two positional degrees of freedom: height; and reach (reach being front-to-back if the arm is facing forward). Each enclosure 24 and 28 is supported by a concavely beveled periphery 180 (FIG. 1) of an aperture in a distal end of its associated distal link 76, 78. The exemplary support allows the enclosure to be rotated in pitch, yaw, and roll about the enclosure's center while being retained against translation relative to the associated distal link.

Figure 5:
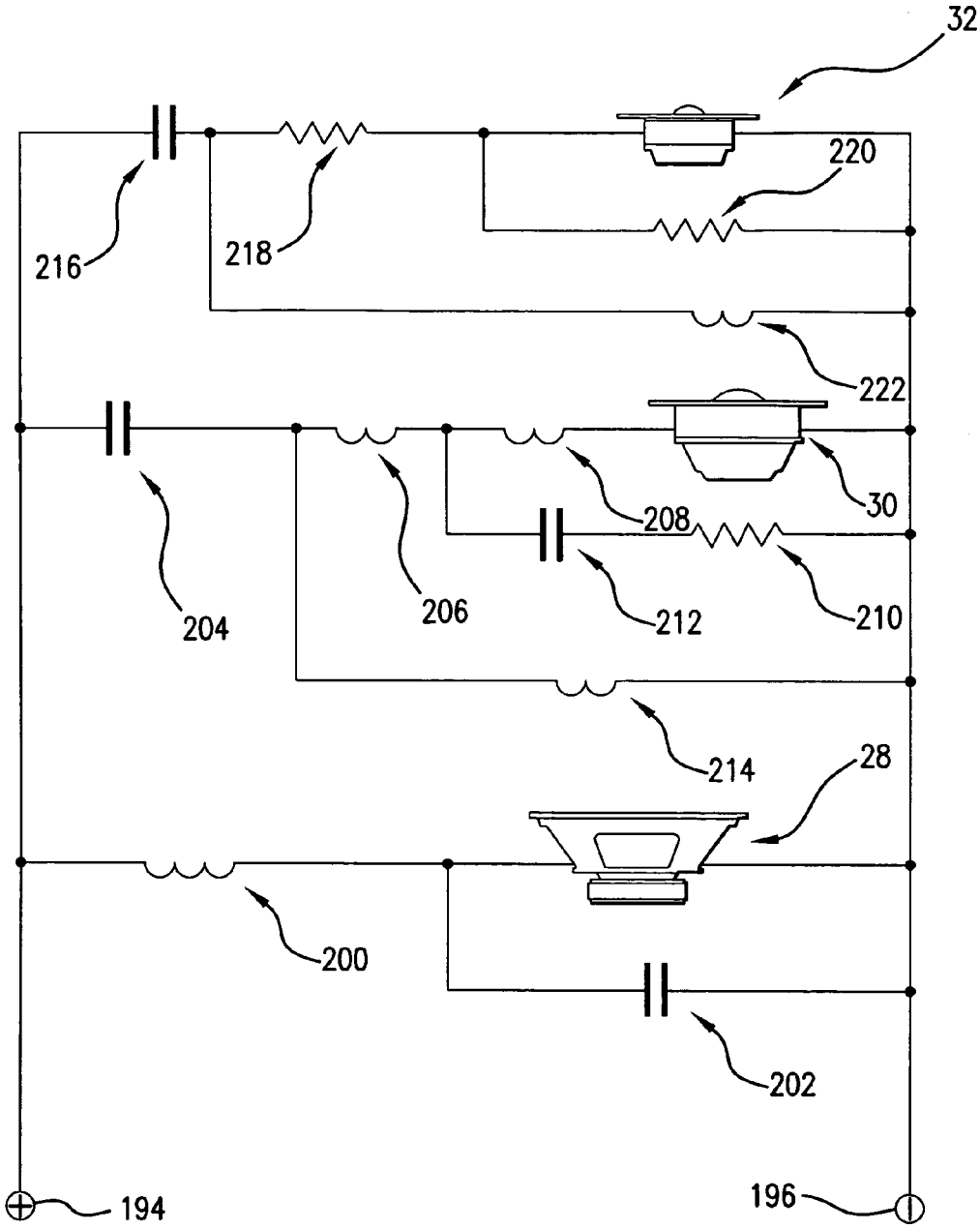
FIG. 5 is a schematic view of a crossover network of the unit of FIG. 1.

FIG. 2 further shows a pair of apertures 190 in each of the shells accommodating terminals 192 for the connection of internal wires from the speaker coils to external wires. FIG. 5 shows crossover circuitry of the loudspeaker unit 20. Positive and negative inputs 194 and 196 may be represented by the terminals 192 of the bass enclosure 28. These may be jumpered to the terminals of the other enclosures. In the exemplary embodiment, the crossover circuitry includes components associated with each of the drivers. The bass driver positive input is coupled to the unit positive input 194 by an inductor 200. Its negative input is coupled to the unit negative input 196. A capacitor 202 is in parallel with the driver 28. The midrange positive input is coupled to the unit positive input 194 by a capacitor 204 and a pair of coils 206 and 208 in series. A series resistor 210 and capacitor 212 are in parallel with the midrange driver 30 and coil 208. A coil 214 is in parallel with this combination and the coil 206. The tweeter positive input is coupled to the unit positive input 194 by a capacitor 216 in series with a resistor 218. A resistor 220 is in parallel with the tweeter driver 32. A coil 222 is in parallel with this combination and the resistor 218. An exemplary circuitry provides a crossover between the bass and midrange of 500 Hz (more broadly 400-800 Hz) and a crossover between the midrange and tweeter of 3500 Hz (more broadly 1.2-4.0 KHz). Alternative circuitry may provide user-adjustable crossover points or other crossover characteristics (e.g., slopes and dB).

Figure 6:
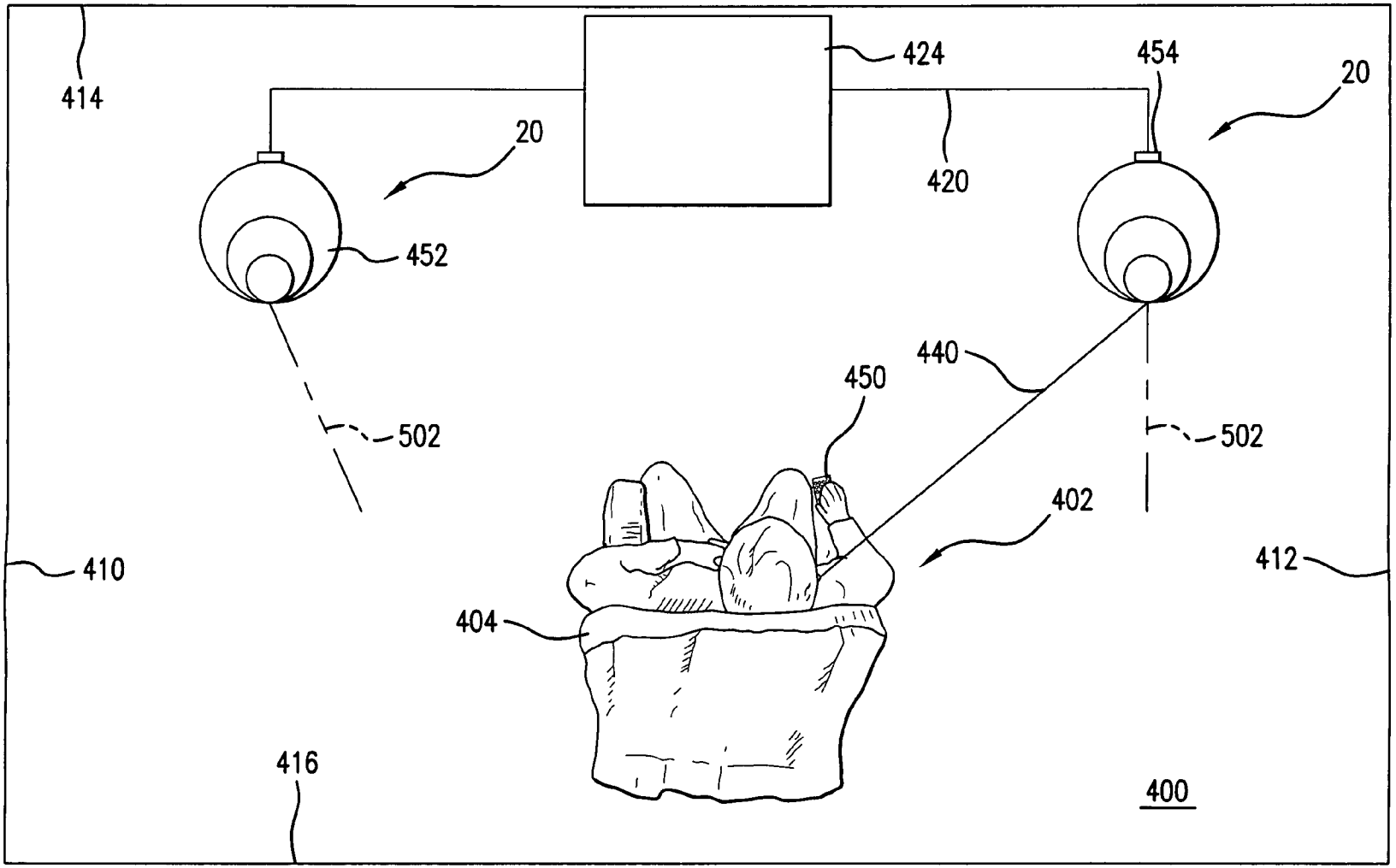
FIG. 6 is a partially schematic view of a room containing a pair of loudspeaker units.

FIG. 6 shows a pair of such loudspeaker units 20 positioned in a room 400 generally facing a user 402 (e.g., seated on a chair, couch, or other accommodation 404) in a listening location. Relative to the user generally facing the speaker pair, the exemplary room 400 has left and right walls 410 and 412 and front and back walls 414 and 416. Other room configurations are possible. The units 20 are connected by external wiring 420 to a source 424 (e.g., including an amplifier and a sound source such as a compact disc player).

Depending on circumstances, there are nearly infinite setup options. For example, some choice of options may depend on whether the user position is predetermined and/or whether a basic speaker unit position is predetermined. In one example, the user position is predetermined and may be off-center in one or more directions. An initial setup step involves approximately positioning the units 20 with a desired approximate separation from each other and a desired approximate distance from the user yet roughly centered relative to the user.

For appropriate phase synchronization, it is advantageous that each sound source be the same distance from the user. The source location for each driver is nominally its coil. The user location may be approximated by the center of the user's head and/or by the locations of the user's left and right ears for the left and right units, respectively. A measuring device 440 is used to provide this phase alignment. A basic measuring device comprises a string, wire, or other elongate flexible member which may be substantially non-stretching to permit consistent length. With one of the two units positioned approximately as desired, the string 440 is placed between the reference user location and the dust cover 48 of the bass driver of that unit. The length is marked or otherwise noted. This length is then used to position the dust cover of the bass driver of the other unit at the same distance. The midranges and tweeters may be similarly positioned at this same distance via adjustment of their associated arms.

In a basic implementation, the enclosures of each unit are positioned so that their centers 500 and axes 502 fall along a common vertical plane. These planes may be parallel to each other. However, many more adjustment options are possible. For example, the further adjustments may be responsive to environmental considerations. FIG. 6 shows the left speaker unit closer to the left wall 410 than the right speaker unit is to the right wall 412. This proximity may cause greater sound reflection off the left wall 410 thereby increasing the perceived sound level of the left speaker unit. This increased perceived sound level may be somewhat frequency-dependent, with particular significance likely being in the low frequency range. Accordingly, to reduce the reflection, the axis 502 (of at least the bass driver) may be angled away from the left wall 410 (e.g., toward the user). The midrange and/or tweeter drivers may, however, be left oriented parallel to the drivers of the right unit or may be otherwise oriented. Differing wall material (e.g., windows vs. drywall) between various of the walls may merit similar adjustments as may factors including room shape, objects in the room, openings (e.g., doors), and the like.

The heights, lateral positions, and orientations of the midrange and tweeter drivers may be adjusted to address similar situations or user preference issues. Typically, however, it would be expected that the same coil-to-user distance be maintained for all drivers. For user preference adjustments, it may be particularly advantageous to automate articulation of the arms so as to allow the user to remain in a single position during adjustment. For example, the user may have a remote control unit 450 controlling motors 452 at the various joints (and optionally replacing separate lockout mechanisms). Each speaker unit may have control circuitry 454 to control the motors.

Optionally integrated with or separate from the control circuitry 454, the speaker units may have adjustable crossovers as described above. The crossover points may also be controlled by the remote control 450 or may be controlled by more manual adjustments.

One or more embodiments of the present invention have been described. Nevertheless, it will be understood that various modifications may be made without departing from the spirit and scope of the invention. For example, a variety of manufacturing techniques may be used for various components. Many arm mechanisms may be imported from different arts or otherwise developed. The arms and principles of their use may be applied to very different enclosures (e.g., parallelepipeds). Accordingly, other embodiments are within the scope of the following claims.

What is claimed is:

1. A speaker system comprising:
a first driver;
a second driver;
a first driver enclosure carrying the first driver;
a second driver enclosure carrying the second driver; and
a first linkage supporting the second driver enclosure relative to the first driver enclosure and providing at least two positional degrees of freedom of movement of the second driver enclosure relative to the first driver enclosure effective to provide phase alignment adjustment of the first and second drivers not dependent on changes in relative orientation.

2. The system of claim 1 wherein the first linkage further provides:
at least one orientational degree of freedom of the second driver enclosure relative to the first driver enclosure.

3. A speaker system comprising:
a first driver;
a second driver;
a first driver enclosure carrying the first driver;
a second driver enclosure camming the second driver; and
a first linkage supporting the second driver enclosure relative to the first driver enclosure and providing at least two positional degrees of freedom of movement of the second driver enclosure relative to the first driver enclosure, and wherein the first linkage comprises an arm having:
a proximal link
a first joint coupling the proximal link to the base for relative rotation about a vertical first axis;
a first intermediate link;
a second joint coupling the proximal link to the first intermediate link for relative rotation about a horizontal second axis;
a second intermediate link;
a third joint coupling the first intermediate link to the second intermediate link for relative rotation about a third axis parallel to and spaced apart from the second axis;
a distal link holding the second enclosure; and
a fourth joint coupling the distal link to the second intermediate link for relative rotation about a fourth axis parallel to and spaced apart from the third first axis.

4. The system of claim 3 wherein the arm further comprises:
a first auxiliary intermediate link and a second auxiliary intermediate link, the first auxiliary intermediate link and the second auxiliary intermediate link positioned to couple rotation about the second, third, and fourth axes so as to limit orientational changes of the distal link.

5. The system of claim 3 wherein the arm further comprises:
a lock, engageable to prevent said relative rotations about said second, third, and fourth axes in a single action.

6. The system of claim 1 further comprising:
a third driver;
a third driver enclosure carrying the third driver; and
a second linkage supporting the third driver enclosure relative to the first driver enclosure and providing at least two positional degrees of freedom of movement of the third driver enclosure relative to the first driver enclosure.

7. The system of claim 6 wherein:
the first and second linkages are fully independent.

8. The system of claim 6 wherein:
the first driver has a diameter greater than a diameter of the second driver and the second driver has a diameter greater than a diameter of the third driver.

9. The system of claim 6 wherein:
each of the first, second, and third enclosures houses no additional driver.

10. The system of claim 6 further comprising:
a single positive-negative connector pair coupled to the first, second, and third drivers to deliver a driving signal.

11. The system of claim 10 wherein there are no additional drivers.

12. The system of claim 6 further comprising:
crossover circuitry coupled to the first, second, and third drivers so as to essentially direct different frequency ranges of an audio signal to each of the first, second, and third drivers.

13. The system of claim 12 wherein the crossover circuitry provides:
a first crossover point between the first and second drivers of 400-800 Hz; and
a second crossover point between the second and third drivers of 1.2-4.0 KHz.

14. The system of claim 6 further comprising:
crossover circuitry having adjustable properties.

15. The system of claim 1 further comprising: a base, supporting the first enclosure and supporting the first linkage independently of the first enclosure.

16. The system of claim 1 further comprising:

at least one motor, coupled to the linkage to actuate movement across said at least two positional degrees of freedom of movement;

a motor controller coupled to the at least one motor to control said at least one motor; and a hand-held wireless remote control apparatus programmed to communicate with the motor controller to control the at least one motor.

17. The system of claim 1 wherein the first and second enclosures have:

a forward portion; and an aft portion essentially shaped as a major section of a spherical shell.

18. The system of claim 1 wherein the first and second enclosures have:

a forward portion having an opening accommodating or exposing the associated driver; and an aft portion essentially shaped as an internally concave continuously curving shell.

19. The system of claim 1 wherein the first and second enclosures consist, in major weight part, of a cementaceous material.

20. A combination of a first system of claim 1, a second system of claim 1, and an amplifier wherein:

the amplifier is connected to the first system to deliver a left stereo channel and to the second system to deliver a right stereo channel.

21. A method for using the combination of claim 20 comprising:

positioning the first drivers of the first and second systems essentially at a given effective distance from a listener; and articulating the first linkage of the first and second systems so as to place the second drivers of the first and second systems essentially at said given effective distance from said listener.

22. The method of claim 21 further comprising:

differently aiming one or more of said first and second drivers of said first and second systems.

23. A speaker system comprising:

a first driver;

a second driver;

a third driver;

a first driver enclosure carrying the first driver and enclosing a backspace of the first driver;

a second driver enclosure carrying the second driver and enclosing a backspace of the second driver;

a third driver enclosure carrying the third driver and enclosing a backspace of the third driver; and means for supporting the second and third driver enclosures relative to the first driver enclosure, the means providing:

at least two positional degrees of freedom of movement of the second driver enclosure relative to the first driver enclosure; and at least two positional degrees of freedom of movement of the third driver enclosure relative to the first driver enclosure.

24. The system of claim 23 wherein the means comprises:

first and second parallelogram mechanisms in series supporting the second driver enclosure; and third and fourth parallelogram mechanisms in series supporting the third driver enclosure.

25. The system of claim 23 wherein the means comprises a first and second parallelogram mechanisms in series.

26. The system of claim 23 wherein the first and second enclosures have:

a forward portion having an opening accommodating or exposing the associated driver; and an aft portion essentially shaped as an internally concave continuously curving shell.

27. A combination of a first system of claim 6, a second system of claim 6, and an amplifier wherein:

the amplifier is connected to the first system to deliver a left stereo channel and to the second system to deliver a right stereo channel.

* * * * *